US005618402A

United States Patent [19]

Sakurai et al.

[11] Patent Number: 5,618,402

[45] Date of Patent: Apr. 8, 1997

[54] TIN-ZINC ALLOY ELECTROPLATING BATH AND METHOD FOR ELECTROPLATING USING THE SAME

[75] Inventors: Hitoshi Sakurai, Matsudo; Tadahiro Ohnuma, Funabashi, both of Japan

[73] Assignee: Dipsol Chemicals Co., Ltd., Tokyo, Japan

[21] Appl. No.: 180,345

[22] Filed: Jan. 12, 1994

[51] Int. Cl.[6] ..... C25D 3/56; C25D 3/60

[52] U.S. Cl. ..... 205/244; 205/252; 205/253; 205/254

[58] Field of Search ..... 205/244, 252, 205/253, 254; 106/1.05, 1.25, 1.29

[56] References Cited

U.S. PATENT DOCUMENTS

| | | | |
|---|---|---|---|
| 4,163,700 | 8/1979 | Igarashi et al. | 204/43 S |
| 4,384,930 | 5/1983 | Eckles | 204/43 S |
| 4,652,347 | 3/1987 | Kobayashi | 204/34 |
| 4,701,244 | 10/1987 | Nobel et al. | 204/253 |

FOREIGN PATENT DOCUMENTS

| | | |
|---|---|---|
| 2185007 | 12/1973 | Germany . |
| 57-2795 | 1/1982 | Japan . |
| 57-2796 | 1/1982 | Japan . |
| 59-48874 | 11/1984 | Japan . |

OTHER PUBLICATIONS

Vagramyan et al. Some features of the electrodeposition of zinc–tin alloy from pyophosphate electrolytes in the presence of surfactants Zashch. Met. 22(4) 615–17 (Russ), 1986 (no month):English ab., article unavail.

Surface Treatment Technology Abstracts, vol. 29, No. 2, pp. 84, Mar./Apr. 1987, L. K. Bobrovskii, et al., "Electrolyte for Electrodeposition of Tin–Zinc Alloy Coatings" (nat trans Dec. 2).

Galvanotechnik, vol. 82, No. 9, p. 3046, Sep. 1991, "Galvanische Zinn–Zink–Uberzuge Als Cadmiumersatz" (nat trans Dec. 2).

*Primary Examiner*—Kathryn L. Gorgos
*Assistant Examiner*—Edna Wong
*Attorney, Agent, or Firm*—Oblon, Spivak, McClelland, Maier & Neustadt, P.C.

[57] ABSTRACT

A tin-zinc alloy electroplating bath comprises an amphoteric surfactant, a water-soluble stannous salt, a water-soluble zinc salt and a balance of water. When the tin-zinc alloy plating bath of the present invention is used, the formed coating film comprises a uniform alloy composition even in case where the current density varies over a wide range. Therefore, the coating film having the uniform alloy composition can be formed even on the substance having a complicated shape and the chromate treatment becomes satisfactory. As a result, the effect of the coating is improved, the resultant product is stable and the productivity is improved. Thus the tin-zinc alloy coating film having a high quality can be provided.

16 Claims, No Drawings

TIN-ZINC ALLOY ELECTROPLATING BATH AND METHOD FOR ELECTROPLATING USING THE SAME

BACKGROUND OF THE INVENTION

The present invention relates to a tin-zinc alloy electroplating bath and a method for electroplating using the same. In particular, the present invention relates to a tin-zinc alloy electroplating bath capable of stably forming a coating of a uniform alloy composition by keeping the plating alloy composition from the influence of the current density.

The tin-zinc alloy electroplating method attracted attention, and recently has come to be widely used as an industrial plating method for automobile parts and electronic parts, since the electroplated products have excellent corrosion resistance, aqueous salt solution resistance and solderability.

The plating baths heretofore proposed for the tin-zinc alloy electroplating include, for example, an alkaline cyanide bath, pyrophosphate bath, borofluoride bath, sulfonate bath, carboxylate bath and cyanide-free alkaline bath. Some of them are practically used.

A defect common to the conventional tin-zinc alloy PLATING BATHS is that the current density exerts a strong influence on the composition of the plating alloy. Namely, even when the current density during the plating is fixed, the current density distribution on the surface of the substance to be plated is not always even and, therefore, the composition of the plating alloy is ununiform. This phenomenon is marked particularly when the substance has a large surface to be plated or a complicated shape.

As a result, the properties of the coating and the quality of the plated substance, i.e. the corrosion resistance, chromate coating film-forming properties and solderability, become various.

As an electroplating bath having small influence due to change in current density, Japanese Patent Publication for Opposition Purpose (hereinafter referred to as "J. P. KOKOKU") No. Sho 57-2795 proposes a citrate bath containing a water-soluble brightener obtained by reacting phthalic anhydride with a reaction product of an aliphatic amine and an organic acid ester, and the bath is now practically used. J. P. KOKOKU No. Sho 57-2796 also discloses a tin-zinc alloy plating bath containing specified amounts of tin sulfate and zinc sulfate and further citric acid (or its salt), ammonium sulfate and sodium sulfate. Further, J. P. KOKOKU No. Sho 59-48874 discloses a tin-zinc alloy plating bath containing citric acid (or its salt), an ammonium salt and a specified polymer.

However, even when such a bath is used for the electroplating, the uniformity of the alloy composition is insufficient, since the plating alloy composition on certain part of surface of substrate having an extremely low current density has a high tin content. Under these circumstances, special facilities are necessitated and a strict operation control is indispensable at present.

SUMMARY OF THE INVENTION

A primary object of the present invention is to provide an electroplating bath capable of forming a coating film having a high quality and comprising a homogeneous tin-zinc plating alloy composition at a current density in a wide range.

Another object of the present invention is to provide a method for forming a homogeneous tin-zinc plating alloy composition on a substrate by electroplating in a tin-zinc electroplating bath.

These and other objects of the present invention will be apparent from the following description and examples.

The present invention was completed on the basis of a finding that the above-described problem can be efficiently solved by adding an amphoteric surfactant to a tin-zinc plating bath.

Namely, the present invention provides a tin-zinc alloy electroplating bath which comprises an amphoteric surfactant, a water-soluble stannous salt, a water-soluble zinc salt and a balance of water.

The present invention further provides a method for forming a tin-zinc plating alloy on a substrate by electroplating in the above-mentioned tin-zinc electroplating bath wherein the substrate is a cathode and tin-zinc alloy is an anode.

DESCRIPTION OF THE PREFERRED EMBODIMENTS

Although the amount of the amphoteric surfactant contained in the tin-zinc alloy electroplating bath is not particularly limited in the present invention, it is preferably 0.01 to 30 g/l, more preferably 0.3 to 15 g/l. When it is below 0.01 g/l, the effect is insufficient and, on the contrary, when it exceeds 30 g/l, the bath is foamed during the plating and the current efficiency is lowered.

The amphoteric surfactants usable herein include those of, for example, imidazoline, betaine, alanine, glycine and amide types. Among them, preferred amphoteric surfactants of imidazoline type are those having a structure of the following formula (1):

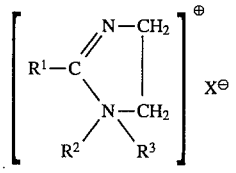

(1)

wherein X represents a halogen, hydroxyl group, sulfuric acid group or hydroxyalkanesulfonic acid group or hydroxycarboxylic acid group having 1 to 10 carbon atoms, $R^1$ represents an alkyl group having 8 to 20 carbon atoms, $R^2$ represents an alkyl group having 1 to 5 carbon atoms and containing a hydroxyl group, and $R^3$ represents a carboxylic acid or sulfonic acid having 1 to 10 carbon atoms or its salt or sulfuric acid ester salt.

The amphoteric surfactants of betaine type are preferably those having a structure of the following formula (2):

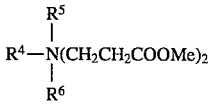

(2)

wherein $R^4$ represents an alkyl group having 8 to 20 carbon atoms, and $R^5$ and $R^6$ may be the same or different and each represent an alkyl group having 1 to 4 carbon atoms, Me represents an alkali metal(same in the below), The amphoteric surfactants of alanine type are preferably those having a structure of the following formula (3) or (4):

$$R^7—NHCH_2CH_2COOMe \quad (3)$$

$$R^7—NH(CH_2CH_2COOMe)_2 \quad (4)$$

wherein $R^7$ represents an alkyl group having 8 to 20 carbon atoms.

The amphoteric surfactants of glycine type are preferably those having a structure of the following formula (5) or (6):

$$R^8—NHCH_2CH_2NHCH_2COOH \quad (5)$$

$$(R^8—NHCH_2CH_2)_2NCH_2COOH \quad (6)$$

wherein $R^8$ represents an alkyl group having 8 to 20 carbon atoms.

The amphoteric surfactants of amide type are preferably those having a structure of the following formula (7):

$$R^9—CONHCH_2CH_2NHCH_2COOme \quad (7)$$

wherein $R^9$ represents an alkyl group having 8 to 20 carbon atoms.

These amphoteric surfactants can be used either singly or in combination of two or more of them.

The tin-zinc alloy electroplating baths of the present invention include, for example, an alkaline cyanide bath, pyrophosphate bath, borofluoride bath, silicofluoride bath, sulfonate bath, carboxylate bath, cyanide-free alkaline bath, gluconate bath and organic acid bath. The bath contains a water soluble stannous salt such as stannous sulfate in an amount of usually 1 to 100 g/l (in terms of metallic tin), preferably 5 to 50 g/l, and a water soluble zinc salt such as zinc sulfate in an amount of usually 0.2 to 80 g/l (in terms of metallic zinc), preferably 25 to 40 g/l. Particularly preferred is the cyanide-free bath. The bath can contain 40 to 400 g/l of a carboxylic acid having 1 to 15 carbon atoms, preferably 3 to 7 carbon atoms such as citric acid or gluconic acid, 30 to 300 g/l of pyrophosphoric acid or 20 to 400 g/l of sulfamic acid. The pH of the bath ranges from 3 to 10.

An ordinary brightener or additive can be added to the plating bath. For example, 0.1 to 20 g/l of a water-soluble brightener obtained by reacting phthalic anhydride with a reaction product of an aliphatic amine and an organic acid ester can be added to the bath.

When the plating bath of the present invention is used, an intended tin-zinc alloy coating having a thickness of, for example, 0.5 μm to 0.5 mm can be formed by the electroplating on a metal such as iron, nickel, copper or an alloy of them. Further, by varying the ratio of tin to zinc in the plating bath, various tin-zinc alloy coating compositions can be obtained. For example, a composition having a zinc content of 5 to 5% by weight is used for the electric contact or the like; a composition having a zinc content of 15 to 45% by weight is used when a high resistance to an aqueous salt solution and to corrosion is necessitated; and a composition having a zinc content of 45 to 90% by weight is used for the formation of a coating having a high corrosion resistance which is to be exposed to air.

Although the electroplating conditions are not particularly limited, the plating bath temperature is preferably 10° to 70° C., more preferably 10° to 40° C. and the current density is preferably 0.1 to 10 A/dm$^2$. The time period for the electroplating is not limited, but preferably 1 minutes to 2 hours, more preferably 5 minutes to 1 hour. In this connection, the substrate is a cathode and tin-zinc alloy is an anode. A weight ratio of tin to zinc in the anode is optional but preferably the ratio may be the same as in the alloy composition formed on the substrate.

The coating formed by using the electroplating bath of the present invention can be treated with a chromate by an ordinary method. The treatment with the chromate can be conducted by, for example, a method described in J. P. KOKOKU No. Sho 38-1110.

When the tin-zinc alloy plating bath of the present invention is used, the formed coating film comprises a uniform alloy composition even in case the current density varies over a wide range. Therefore, the coating film having the uniform alloy composition can be formed even on the substrate having a complicated shape, and the chromate treatment becomes satisfactory. As a result, the effect of the coating film is improved, the resultant product is stable and the productivity is improved. Thus the tin-zinc alloy coating film having a high quality can be provided.

The following Examples will further illustrate the present invention. The composition of the plating bath and the plating conditions can be changed depending on the object.

EXAMPLE 1

The basic tin-zinc alloy plating bath used in the Examples of the present invention are given in Table 1.

TABLE 1

Basic plating bath used in Examples

| Bath | | |
|---|---|---|
| Citrate bath | Gluconate bath | Pyrophos bath |
| Bath composition | | |
| Stannous sulfate (40 g/l) | Stannous sulfate (40 g/1) | Stannous pyrophosphate (20 g/1) |
| Zinc sulfate (40 g/l) | Zinc sulfate (40 g/1) | Zinc pyrophosphate (40 g/1) |
| Citric acid (100 g/l) | Gluconic acid (120 g/1) | Pyrophosphoric acid (100 g/1) |
| Ammonium sulfate (80 g/l) | Ammonium sulfate (80 g/l) | |
| pH adjustor | | |
| Sodium hydroxide or ammonia water | Sodium hydroxide or ammonia water | Potassium hydroxide |
| Plating bath temp.: | Citrate bath and gluconate bath: 25° C. Pyrophosphate bath 60° C. | |

In this Example, the electroplating was conducted at the above-mentioned bath temperature for 10 to 60 min, wherein an iron sheet was used as the cathode and a tin-zinc alloy sheet (weight ratio of tin to zinc is 90/50) was used as the anode and the current density was 0.2 to 5 A/dm$^2$.

The compositions of the tin-zinc alloy plating bath containing the amphoteric surfactant used in the Example and also of the coating alloy film obtained from the bath are given in Table 2.

For comparison, the compositions of the amphoteric surfactant-free plating bath and also of the coating alloy film obtained from the bath are also given in Table 2.

TABLE 2

Compositions of plating bath and formed coating alloy film

| No. | Basic plating bath | pH of plating bath | Amphoteric surfactant Compound | Amount |
|---|---|---|---|---|
| 1 | Citrate bath | 6.0 | Coconut oil alkyl-N-carboxyethyl-N-hydroxyethyl-imidazolium betaine chloride | 5 g/l |
| 2 | Citrate bath | 6.0 | Coconut oil alkyl-N-carboxyethyl-N-hydroxyethyl-imidazolium betaine chloride | 5 g/l |
| 3 | Citrate bath | 9.0 | Stearyldimethylammonium betaine | 1 g/l |
| 4 | Citrate bath | 5.0 | Na salt of cetyldi(amino-ethyl)glycine | 10 g/l |
| 5 | Citrate bath | 5.0 | Na salt of cetyldi(amino-ethyl)glycine | 1 g/l |
| 6 | Citrate bath | 6.0 | Laurylamide propylbetaine | 1 g/l |
| 7 | Citrate bath | 6.0 | Laurylamide propylbetaine | 1 g/l |
| 8 | Citrate bath | 6.0 | Pentadecanoamide propylbetaine | 10 g/l |
| 9 | Citrate bath | 7.0 | Sodium undecylaminoethyl-carboxylate | 5 g/l |
| 10 | Citrate bath | 7.0 | Sodium undecylaminoethyl-carboxylate | 5 g/l |
| 11 | Gluconate bath | 3.0 | 2-Myristyl-1-carboxymethyl-1-hydroxypropylimidazolinium betaine | 2 g/l |
| 12 | Gluconate bath | 6.0 | 2-Myristyl-1-carboxymethyl-1-hydroxypropylimidazolinium betaine | 2 g/l |
| 13 | Pyrophosphate bath | 9.0 | Lauryldiethylaminoacetic acid betaine | 5 g/l |
| 14 | Citrate bath | 6.0 | 2-Cetyl-1-carboxymethyl-1-hydroxypropylimidazolinium betaine | 1 g/l |
| 15 | Citrate bath | 7.5 | Lauryldiethylammoniumbetaine | 2 g/l |
| 16 | Citrate bath | 5.0 | Lauryl-N-hydroxyethyl-N-sulfoethylimidazolinium betaine | 5 g/l |
| 31 | Citrate bath | 6.0 | None | — |
| 32 | Citrate bath | 9.0 | None | — |
| 33 | Gluconate bath | 3.0 | None | — |
| 34 | Gluconate bath | 6.0 | None | — |
| 35 | Pyrophosphate bath | 9.0 | None | — |
| 36 | Citrate bath | 6.0 | None | — |
| 32 | Citrate bath | 7.5 | None | — |

| | | | | Plating alloy composition (zinc content; %) | | |
|---|---|---|---|---|---|---|
| No. | Other additives | Amount | Appearance of plated product | cathode 0.2 A/dm$^2$ | current 1.5 A/dm$^2$ | density 5 A/dm$^2$ |
| 1 | None | — | Dull | 31.2 | 40.3 | 43.0 |
| 2 | Aromatic aldehyde | 0.1 g/l | Semiglossy | 28.0 | 38.6 | 39.2 |
| 3 | None | — | Dull | 25.5 | 38.8 | 41.2 |
| 4 | None | — | Dull | 20.7 | 35.6 | 34.7 |
| 5 | DIPSOL ® DG-FR-7 | 0.1 g/l | Semiglossy | 20.1 | 35.1 | 35.7 |
| 6 | None | — | Dull | 21.3 | 38.4 | 39.4 |
| 7 | DIPSOL ® SZ-240S | 8 ml/l | Semiglossy | 20.5 | 35.1 | 38.5 |
| 8 | None | — | Dull | 27.0 | 37.6 | 41.0 |
| 9 | None | — | Dull | 21.5 | 34.9 | 37.7 |
| 10 | DIPSOL ® SZ-240S | 8 ml/l | Semiglossy | 19.3 | 34.4 | 38.2 |
| 11 | Polyoxyethylene laurylamine (15 mol ethylene oxide adduct) | 5 g/l | Semiglossy | 20.5 | 35.9 | 39.3 |
| 12 | None | — | Dull | 23.3 | 36.6 | 39.0 |
| 13 | None | — | Semiglossy | 25.0 | 38.9 | 40.5 |
| 14 | Aliphatic amine/ organic acid ester/ phthalic anhydride reaction product | 2 ml/l | Semiglossy | 10.3 | 11.8 | 12.3 |
| 15 | None | — | Dull | 54.6 | 68.6 | 74.6 |
| 16 | Epoxy compound/ propylene glycol reaction product | 2 g/l | Semiglossy | 67.9 | 80.3 | 82.4 |
| 31 | DIPSOL ® SZ-240S | 8 ml/l | Semiglossy | 12 | 35 | 37.5 |
| 32 | DIPSOL ® SZ-240S | 8 ml/l | Semiglossy | 9.0 | 48.3 | 50.6 |
| 33 | Polyoxyethylene laurylamine (15 mol ethylene oxide adduct) | 5 g/l | Semiglossy | 8.5 | 17.0 | 33.8 |

TABLE 2-continued

| | | | | | | |
|---|---|---|---|---|---|---|
| 34 | Polyoxyethylene laurylamine (15 mol ethylene oxide adduct) | 5 g/l | Semiglossy | 9 | 35 | 45 |
| 35 | None | — | Spongy surface | — | — | — |
| 36 | Aliphatic amine/ organic acid ester/ phthalic anhydride/ reaction product | 2 ml/l | Semiglossy | 8.4 | 15.0 | 19.7 |
| 37 | Polyethylene glycol | 5 g/l | Semiglossy | 18.1 | 40.2 | 51.9 |

In the above Table, Nos. 1 to 16 are Examples, and Nos. 31 to 37 are Comparative Examples. In Nos. 14, 15, 16, 36 and 37, the amounts of tin and zinc (g/l each in terms of the metal) in the bath were as follows:

| | No. | | | | |
|---|---|---|---|---|---|
| | 14 | 15 | 16 | 36 | 37 |
| Tin | 20 | 10 | 5 | 20 | 10 |
| Zinc | 1 | 20 | 20 | 1 | 20 |

What is claimed is:

1. A tin-zinc alloy electroplating bath which comprises:

0.01 to 30 g/l of an amphoteric surfactant selected from the group consisting of imidazolines, betaines, alanines, glycines and amides, 1 to 100 g/l of a water-soluble stannous salt, 0.2 to 80 g/l of a water-soluble zinc salt, 40 to 400 g/l of a carboxylic acid having 1 to 15 carbon atoms or 30 to 300 g/l of a pyrophosphoric acid, and a balance of water, wherein said electroplating bath has a pH of 3 to 10.

2. The tin-zinc alloy electroplating bath of claim 1 wherein the amphoteric surfactant is an imidazoline.

3. The tin-zinc alloy electroplating bath of claim 1 wherein the amphoteric surfactant is present in an amount of 0.3 to 15 g/l.

4. The tin-zinc alloy electroplating bath of claim 1 wherein the water-soluble stannous salt is present in an amount of 5 to 50 g/l in terms of metallic tin.

5. The tin-zinc alloy electroplating bath of claim 1 wherein the water-soluble zinc salt is present in an amount of 25 to 40 g/l in terms of metallic zinc.

6. The tin-zinc alloy electroplating bath of claim 1 which is a cyinide-free bath.

7. The tin-zinc alloy electroplating bath of claim 1 which further comprises 0.1 to 20 g/l of a water soluble brightener.

8. The tin-zinc alloy electroplating bath of claim 1, comprising 0.3 to 15 g/l of said amphoteric surfactant, and 5 to 50 g/l of said water-soluble stannous salt, wherein said amphoteric surfactant is imidazoline.

9. A method for forming a tin-zinc alloy on a substrate, comprising electroplating a substrate in a tin-zinc electroplating bath comprising:

0.01 to 30 g/l of an amphoteric surfactant selected from a group consisting of imidazolines, betaines, alanines, glycines and amides, 1 to 100 g/l of a water-soluble stannous salt, 0.2 to 80 g/l of a water-soluble zinc salt, 40 to 400 g/l of a carboxylic acid having 1 to 15 carbon atoms or 30 to 300 g/l of a pyrophosphoric acid, and a balance of water, wherein the substrate is a cathode and tin-zinc alloy is an anode, and said electroplating bath has a pH of 3 to 10.

10. The method of claim 9 wherein the amphoteric surfactant is present in an amount of 0.3 to 15 g/l.

11. The method of claim 9 wherein the water-soluble stannous salt is present in an amount of 5 to 50 g/l in terms of metallic tin.

12. The method of claim 9 wherein the water-soluble zinc salt is present in an amount of 25 to 40 g/l in terms of metallic zinc.

13. The method of claim 9 wherein an electroplating bath temperature is 10° to 70° C. and a current density is 0.1 to 10 $A/dm^2$.

14. The method of claim 9, wherein said tin-zinc electroplating bath further comprises 30 to 300 g/l of a pyrophosphoric acid.

15. A tin-zinc alloy electroplating bath, comprising:

0.01 to 30 g/l of an amphoteric surfactant, 1 to 100 g/l of a water-soluble stannous salt, 0.2 to 80 g/l of a water-soluble zinc salt, 30 to 300 g/l of a pyrophosphoric acid, and a balance of water.

16. A tin-zinc alloy electroplating bath comprising:

0.01 to 30 g/l of an amphoteric surfactant, 1 to 100 g/l of a water-soluble stannous salt, 0.2 to 80 g/l of a water-soluble zinc salt, 40 to 400 g/l of a carboxylic acid having 1 to 15 carbon atoms, and a balance of water.

* * * * *